United States Patent [19]

Smith

[11] Patent Number: 4,990,032

[45] Date of Patent: Feb. 5, 1991

[54] RETAINING WALL MODULE WITH ASYMMETRICAL ANCHOR

[75] Inventor: Peter J. Smith, Gansevoort, N.Y.

[73] Assignee: Fomico International, Inc., New York, N.Y.

[21] Appl. No.: 472,324

[22] Filed: Jan. 30, 1990

[51] Int. Cl.[5] ..... E02D 29/02

[52] U.S. Cl. ..... 405/286; 52/608; 405/273; 405/284

[58] Field of Search ..... 405/33, 258, 262, 273, 405/284, 285, 286; 52/608, 609, 610, 611

[56] References Cited

U.S. PATENT DOCUMENTS

| | | | |
|---|---|---|---|
| 1,472,917 | 11/1923 | Laird | 405/273 |
| 1,993,291 | 3/1935 | Vermont | 405/286 |
| 2,149,957 | 3/1939 | Dawson | 405/273 |
| 3,667,186 | 6/1972 | Kato | 405/29 X |
| 3,953,979 | 5/1976 | Kurose | 405/286 |
| 3,981,038 | 9/1976 | Vidal | 14/26 |
| 4,051,570 | 10/1977 | Hilfiker | 14/26 |
| 4,324,505 | 4/1982 | Hilfiker et al. | 405/284 |
| 4,426,176 | 1/1984 | Terada | 405/285 |
| 4,449,857 | 5/1984 | Davis | 405/286 |
| 4,616,959 | 10/1986 | Hilfiker | 405/286 |
| 4,661,023 | 4/1987 | Hilfiker | 405/262 |
| 4,684,294 | 8/1987 | O'Neill | 405/286 |
| 4,728,227 | 3/1988 | Wilson et al. | 405/284 |
| 4,824,293 | 5/1989 | Brown et al. | 405/284 |
| 4,884,921 | 12/1989 | Smith | 405/286 |

FOREIGN PATENT DOCUMENTS 2409351 6/1979 France .

OTHER PUBLICATIONS

Teng, W. C., Foundaton Design, Prentice-Hall, Inc. 1962, pp. 375-377.

Liu, C. & Evett, J. B., Soils and Foundations, 2nd Ed., Prentice-Hall, Inc., pp. 368-371.

*Primary Examiner*—David H. Corbin

*Attorney, Agent, or Firm*—Kenyon & Kenyon

[57] ABSTRACT

Individual precast concrete wall units for erecting a retaining wall structure each includes a face member, a support member, and an anchor member. The support member has a front portion that is connected to the face member, either at the center of the face member or, more preferably, at a location spaced from one side edge by one-fourth the distance between one side edge and the other side edge of the face member. The anchor member is formed as two wings of unequal length that extend from a rear portion of the support member at angles of at least 90°, and preferably 135°, with respective sides of the support member. When the units are assembled in a horizontal row, spaces are left between the anchor wings of adjacent units that permit access by a power tamper to the region between the face members and the anchor members to tamp backfilled earth in this region to a required compression. The anchor wings may have lateral open-ended slots to accept metal grid or perforated polymer mats extending in horizontal layers from near the face members to behind the anchor members to reinforce backfilled material both forward and to the rear of the anchor members.

9 Claims, 6 Drawing Sheets

RETAINING WALL MODULE WITH ASYMMETRICAL ANCHOR

BACKGROUND OF THE INVENTION

1. TECHNICAL FIELD

The present invention relates to retaining walls and particularly to stackable precast concrete modular crib-type structures for creating retaining walls.

2. BACKGROUND INFORMATION

A solid block gravity retaining wall is probably the oldest known kind of retaining wall. This type of wall relies on the mass of the wall material and a configuration that normally decreases in thickness from base to top to resist the overturning force exerted by the pressure of earth behind it. Gravity retaining walls are usually made of stone, concrete block, or monolithic concrete poured at the site.

Another type of retaining wall is a cribbing wall constructed from interlocking timbers or precast concrete elements. U.S. Pat. No. 2,149,957 of DAWSON and U.S. Pat. No. 1,472,917 of LAIRD show examples of cribbing arrangements using precast concrete elements. The Dawson cribbing wall is elements: stretchers, headers, and anchors. The stretchers and headers are elongated straight elements having interengaging socket-and-lug ends that can be locked together by impaling rods. The stretchers form the face of the wall, and the headers extend perpendicularly to the face into the bank behind the wall. The anchors are U-shaped elements that interengage with the inner ends of the headers to create a hollow box-like structure, or crib. Each rigid element is cast separately, and the cribbing is assembled piece-by-piece at the site.

The LAIRD cribbing wall system also includes stretchers, headers, and anchors. In LAIRD, however, Y-shaped spread arms are cast integrally with a header member for anchorage purposes, thereby eliminating the necessity of tying the header member to another member to provide an anchor. According to LAIRD, the 45° spread arms of the header member form an anchor with a maximum of efficiency, as the maximum amount of filling would have to be displaced before the header members would move. The forward end of each header carries two vertical pins that engage holes in adjacent ends of two stretchers laid end-to-end. These pins provide a positive connection between the header members and alternate rows of stretcher members. The stretcher members in adjacent rows are staggered, so that the stretcher members likewise are connected to alternate rows of header members, and the anchoring arms are so arranged that in straight wall construction the rear ends of alternate layers of headers bear on each other and may be pin-connected for accurate alignment.

One-piece precast cribbing or bin-type units also have been developed that can be stacked to make a vertical retaining wall. In most systems, individual units interlock with other units to form an integral structure of open bins which are subsequently backfilled with earth or gravel to add the necessary mass to the wall structure. These elements are of various shapes, but they typically have a flat face panel, a flat rear panel or a stretcher, and at least one web or connecting arm extending between the rear of the face panel and the rear panel or stretcher. U.S. Pat. No. 1,909,539 of Huntoon, U.S. Pat. No. 3,877,236 of O'Neill et al., and U.S. Pat. No. 4,372,091 of Brown et al., and French Patent Publication No. 2,409,351 provide examples of such units. In the O'Neill and Brown et al. units, the rear panel is usually the same length as the front panel or only slightly shorter. The rear panel of the Huntoon unit is significantly shorter than the front panel, and the module of French '351 has only solid wedge-shaped enlargements at the rear ends of two connecting arms.

The crib-type or bin-type systems, whether composed of individual face members, headers, and stretchers or of one-piece modular units, act essentially as gravity walls. That is, they resist lateral pressure and overturning moments by reason of the front-to-rear dimensions and the weights of the individual units, where the weight of a unit includes the weight of backfill material captured within the spaces between the front panels and rear panels or stretchers. As a result, the individual units, particularly the one-piece modular units, can become relatively large and correspondingly heavy.

Gravity walls of the types described above must be able to resist the pressure of backfill behind them. Since this pressure increases with depth of backfill, gravity walls typically are thicker at the base than at the top. As a practical matter, the front-to-rear dimension of precast concrete modules is limited by transport weight and size restrictions, so that modular gravity-type retaining walls have an ultimate height limitation.

An alternative to gravity-type retaining walls is the stabilized earth system as disclosed in U.S. Pat. No. 3,981,038 of VIDAL. In this system, a plurality of elongated reinforcing members are arranged in vertically spaced horizontal layers. Within each layer the members are spaced apart laterally, and some of the members extend at right angles to other members to form a lattice. Compacted earth fills the vertical array of horizontal lattices, and at least one elongated reinforcing member is attached to each of a number of precast concrete facing elements. The facing elements are in the form of panels which are provided with lugs extending from the rear faces, each lug being connected by bolts to one of the horizontal reinforcing strips.

Instead of relying on frictional resistance between soil and individual reinforcing strips, other soil reinforcing systems use welded wire mesh or grids. U.S. Pat. No. 4,324,508 of HILFIKER et al., U.S. Pat. No. 4,449,857 of DAVIS, U.S. Pat. Nos. 4,616,959 and 4,661,023 of HILFIKER, U.S. Pat. No. 4,728,227 of WILSON et al., and U.S. Pat. No. 4,824,293 of BROWN et al. disclose different arrangements for positively connecting metal grid or perforated polymer reinforcing mats to face panels of a retaining wall.

The stabilized earth systems are suited primarily to highway grade separation crossings, railway underpasses, and similar situations where minimal preliminary excavation is needed and there is ample space behind the wall for tamped backfill. The gravity type of retaining walls are normally employed where there is a steep cut bank with limited space behind the wall units for soil reinforcing members.

SUMMARY OF THE INVENTION

It is a principal object of the present invention to provide an inexpensive retaining wall of precast concrete one-piece modular units, each having a face panel, a support member, and an anchor member, wherein the wall provides superior stability in relation to the size and weight of the unit.

Another object of the invention is to provide a retaining wall of inexpensive precast concrete units which stack together, support member upon support member, while the front faces interlock as in a running brick bond to provide maximum stability and interlock along the face of the wall.

Another object of the invention is to provide precast concrete retaining wall units that can be combined with mesh or grid soil stabilization systems to effectively integrate the units with a backfilled soil bank behind the units without requiring direct connection between the units and the stabilizing mesh system.

Yet another object of the invention is to provide concrete retaining wall units that can be used to assemble a retaining wall of any desired height.

Another object of the invention is to provide concrete retaining wall units that create a vertical retaining wall, when stacked in staggered rows, in which the units are interlocked to resist both hydrostatic pressure and overturning moment forces without the need for additional fastening means.

The above and other objects are achieved by a precast concrete retaining wall unit for use in constructing a retaining wall composed of superposed rows of such units, the unit comprising:

a face member having a front surface, a rear surface, an upper edge, a lower edge, and first and second side edges;

a single support member having a top, a bottom, a first side, a second side, a front end portion, a rear end portion spaced from the front end portion, and an intermediate portion connecting the front and rear end portions, the front end portion of the support member being connected to the rear surface of the face member; and an anchor member formed integrally with the rear end portion of the support member, the anchor member including a first wing extending at an angle of at least 90° from the first side of the support member and a second wing extending at an angle of at least 90° from the second side of the support member opposite to the first side, the length of the first wing being less than the length of the second wing.

Preferably, the front end portion of the support member is formed integrally with the face member so as to extend rigidly and substantially perpendicularly to the rear surface of the face member at a location spaced from the first side edge of the face member by approximately one-fourth the distance between the first and second side edges of the face member. By offsetting the connection of the single support member to a "quarter point" of the face panel, it is possible to stagger the wall units in successive rows while maintaining the support members in each row in vertical alignment with the corresponding support members of the units in the rows below and above.

Also preferably, each of the first and second wings of the anchor member extends at an angle of approximately 135° with the respective side of the support member. These swept back wings capture the maximum amount of earth backfill for a given support member length. Also, the swept back wings of unequal length create openings between the wings of adjacent units in a row. The openings permit easy access to the bins formed between the face panels and the anchor wings to backfill and power tamp earth in these bins.

In an alternative embodiment that is particularly suitable for use in applications where backfill extends a substantial distance behind the anchor members, each anchor wing may have at least one horizontal slot or opening extending inward from the outer side edge of the wing. These slots or openings loosely receive one or more metal or polymer grid mats per unit that are laid close to each side of the support member in vertically spaced layers extending from adjacent to the rear surface of the face panel to the region behind the unit during the assembly of a backfilled retaining wall. The portions of the mats between the face panels and the anchor members of adjacent units reinforce and engage the earth backfill in this region so that the backfill becomes essentially a monolithic part of the wall units, and the portions of the mats behind the anchor members reinforce and engage the earth backfill in that region, thereby effectively adding the total mass of reinforced backfill to the wall system. This arrangement adds the tensile strength of the reinforcing mats along with the earth mass captured by them to the pure gravity wall effect of the units without the reinforcing mats in resisting displacement and overturning forces acting on the wall structure. The narrow horizontal slots provide a means of attaching the reinforcing mats to the concrete structure without using expensive and corrodible hardware.

BRIEF DESCRIPTION OF THE DRAWINGS

Additional features and advantages of the invention will be discussed in the following detailed description of specific preferred embodiments shown by the drawings, in which.

DETAILED DESCRIPTION OF THE PREFERRED EMBODIMENTS

Figures 1, 2:
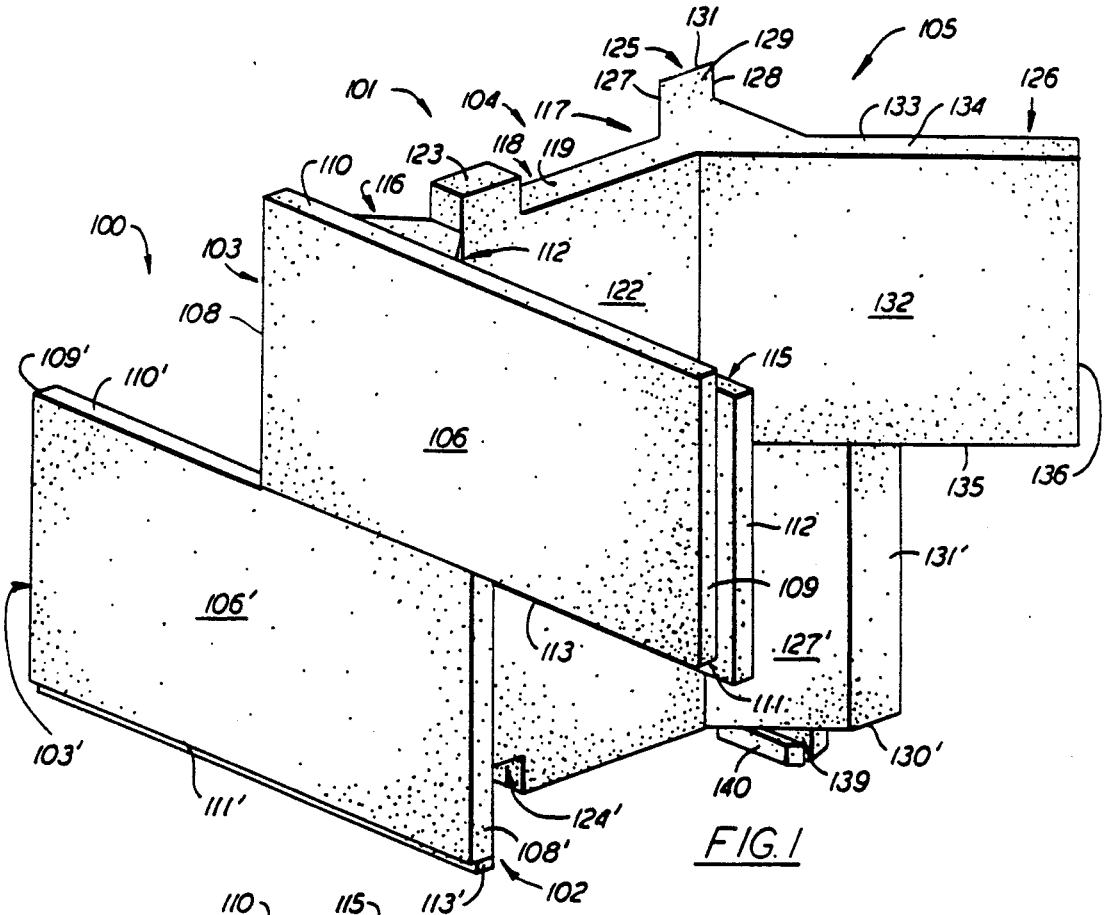
FIG. 1 is a perspective view of two precast concrete units according to a first embodiment of the invention, the units being stacked one on the other in the normal intended relation.
FIG. 2 is a rear view, from above, of the two vertically stacked precast concrete units as shown in FIG. 1.

In the following description, the same elements of identical units of a single embodiment shown in different figures will be identified by the same three-digit reference numerals, with the elements of a closely similar unit of the same embodiment identified by the same reference numerals followed by a prime (′). Corresponding elements in alternative embodiments will be identified by reference numerals having the same last two digits but a different first digit.

To illustrate various features of the invention, FIGS. 1 and 2 show two views of a partial retaining wall assembly 100 composed of two interlocking individual wall units 101 and 102 according to a first embodiment of the invention. Unit 101 is a "right-handed" unit and unit 102 a "left-handed" unit, to provide advantages described in detail below. Unit 101 is stacked in offset or staggered relation on unit 102. A complete wall assembly would include a first horizontal row of contiguous units identical to unit 102, a second row of contiguous units identical to unit 101, and further rows, as necessary, alternating between units 102 and units 101 (see FIG. 5). The units in each succeeding row are shifted to straddle two units in the row on which they rest, and each unit includes means for interengaging contiguous units above, below, and to each side to create a self-locking wall structure. Although not shown in FIG. 5, each row or course of units is usually backfilled with tamped earth before proceeding with the next row.

Figure 3:
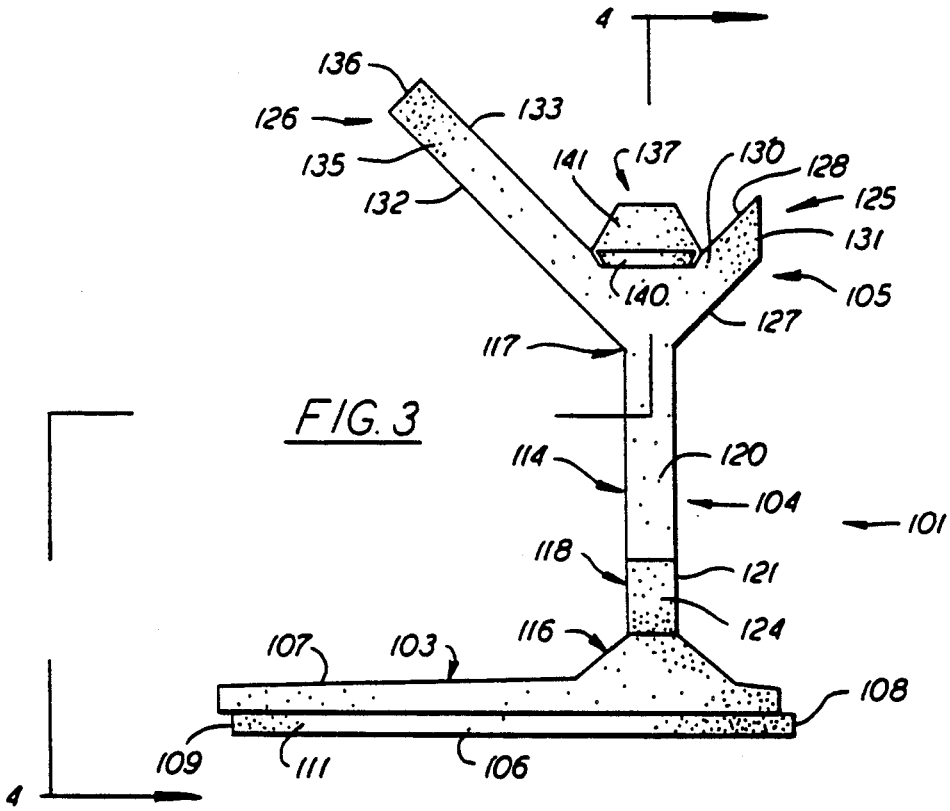
FIG. 3 is a bottom plan view of one of the wall units of FIGS. 1 and 2.
Figure 4:
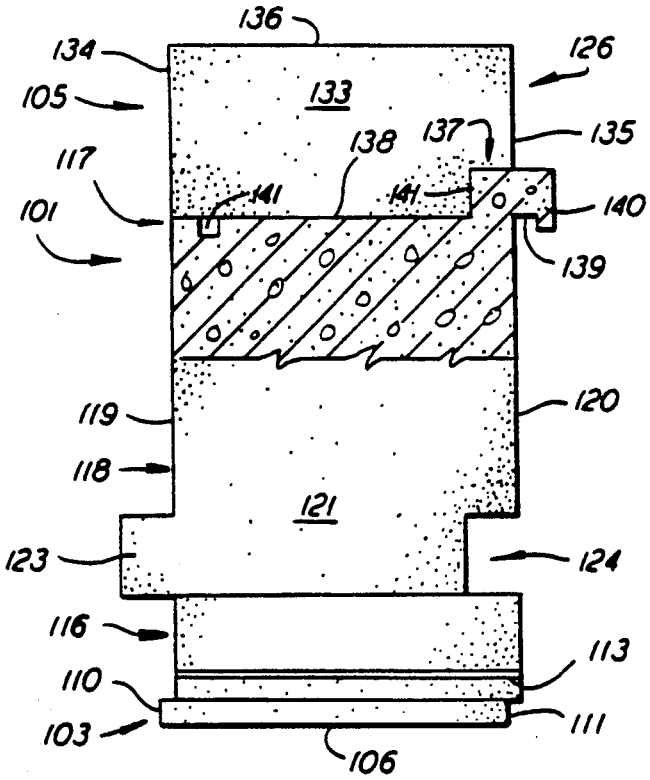
FIG. 4 is a side elevation view, partly in section, taken along the line 4—4 of FIG. 3.

FIGS. 3 and 4 show the construction and features of an individual "left-handed" wall unit 101 of the first embodiment. Each wall unit 101 includes a face member 103, a support member 104, and an anchor member 105.

The face member 103 preferably is formed as a rectangular panel having a front surface 106, a rear surface 107, first and second side edges 108, 109, an upper edge 110, and a lower edge 111. Optionally, the second side edge may have a rear lip 112 and the lower edge a rear lip 113, while the first side edge and upper edge have corresponding rear recesses 114 and 115. Of course, it is arbitrary which edges have lips and which edges have recesses, so long as edges of adjacent units are configured so that a lip on one edge will mate with a recess on an edge of an adjacent unit.

The support member 104 has a front end portion 116, a rear end portion 117, and an intermediate portion 118 that connects the rear end portion to the front end portion. In this embodiment, the front portion of the support member is trapezoidal in horizontal cross section and provides a rigid integral connection between the face panel and the support member. The location of the connection is spaced from the first side edge of the face panel by one-fourth the distance between the first and second side edges. The intermediate portion 118 of the support is formed as a flat generally rectangular concrete panel having a top 119, a bottom 120, a first side 121, and a second side 122, and the rear portion merges integrally into the anchor member 105.

As best shown in FIG. 4, an integral tab or tenon 123 extends from the top of the forward end of the intermediate portion, and a matching notch or mortise 124 is formed in the bottom of the intermediate portion.

The anchor member 105 includes a first wing 125 and a second wing 126. First wing 125 extends from the first side of the support member at an angle of approximately 135° and has a front face 127, a rear face 128, a top 129, a bottom 130, and an outer edge 131. Second wing 126 extends at an equal angle from the second side of the support member and similarly has a front face 132, a rear face 133, a top edge 134, a bottom edge 135, and an outer edge 136. The first wing extends to approximately a plane perpendicular to, and including the first side edge of, the face member. The second wing is substantially longer than the first wing, and it may extend to a plane perpendicular to, and including the second side edge of, the face member. Since the second side edge is farther from the support member than the first side edge, the second wing can be substantially longer than the first wing without interfering with adjacent wall units, but it is not necessary that it extend as far as to the perpendicular plane containing the second side edge to obtain maximum anchoring effectiveness, as will be explained below in connection with FIG. 5.

A further feature of this embodiment is a rear interlock in the form of a prismatic stub 137 formed on a rear surface 138 of the support member and extending below the bottom of the support member. The stub has a front face 139 that is coplanar with the rear face of the support member, and a lip 140 on the front face of the stub is sized and located to engage an indentation 141 in the rear face of the support member of a unit disposed immediately below. The relative placement of the lip 140 and indentation 141, as well as of the tab 123 and the notch 124, are best shown in FIG. 4.

With reference once again to FIGS. 1 and 2, the "left-handed" unit 102 is a mirror image of the "right-handed" unit 1O1. Since the corresponding elements of the two units are the same, except for the "handedness" of the units, they are identified by the same reference numerals plus a prime. The description of unit 1O1 given above thus applies equally to unit 102, except for substituting primed for unprimed reference numerals.

Figure 5:
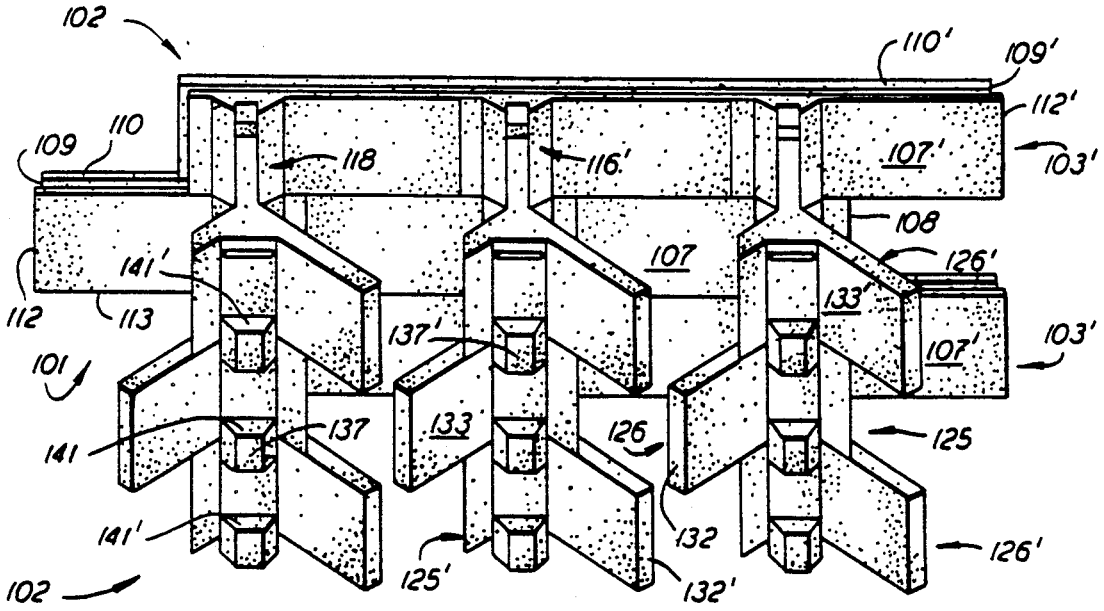
FIG. 5 is a rear view, from above, of a wall assembly of precast concrete units in three staggered rows.

FIG. 5 shows a retaining wall assembly from the rear and above, the assembly comprising a bottom row of "left-handed" units 102, an intermediate row of "right-handed" units 101, and a top row of units 102. The support members of each row of units are vertically aligned on support members of respective units in the row immediately below. As evident from the drawing, this arrangement provides a strong and stable wall system, since the weight of units above the units in a given row is distributed over the full top area of the support members. Because of the alternating "handedness" of the units, the face members of units in successive rows can be staggered for maximum stability, while maintaining the vertical alignment of the support members. Also, because of the large space between the anchor wings of adjacent units, the wall can be arranged in a convex curve of relatively short radius, which is a distinct advantage of the present invention. The triple interlocking of the lips and recesses of the face members, of the mortises and tenons of support members of vertically adjacent units, and of the lips and recesses of the rear stubs results in a retaining wall assembly that acts as a monolithic unit to resist both lateral forces and overturning moments applied by backfilled material behind the wall.

In this connection, it should be noted that the top 141 of each stub 137 (and the corresponding top 141′ of each stub 137′) presents a horizontal surface that carries a modest but significant weight of backfill material to further resist overturning moments on the wall assembly. Although subject to empirical verification, it is believed that the positioning of this "shelf" surface between the rear faces of the two anchor wings will generate resistance to overturning by an inverted wedge of earth backfill above the shelf, and not merely by a column of earth having a cross section equal to the area of the shelf.

FIG. 5 also illustrates clearly the previously mentioned openings provided between the wings of adjacent units in a row to permit easy access for a power tamper to the semi-enclosed regions between the face members and the anchor members for tamping backfill material in these regions. This feature provides important benefits in time saving and improvement of the control over the compression of backfill. Despite these openings, however, the angled anchor wings are believed to effectively capture all of the backfill material placed between the anchor members and the face members of adjoining units. This capture occurs because, at the preferred 135° angle of the wings, the shear plane extending approximately perpendicularly to the outer edge of each second wing intersects the first wing of the adjacent unit. In addition, the first and second wings of successive rows of units are reversed so that the second wings of one row overlie the first wings of the row immediately below. Thus, the anchor members of units in successive rows complement each other to effectively capture an earth volume that extends from the face members to the outer edges of the second anchor wings.

Figure 6:
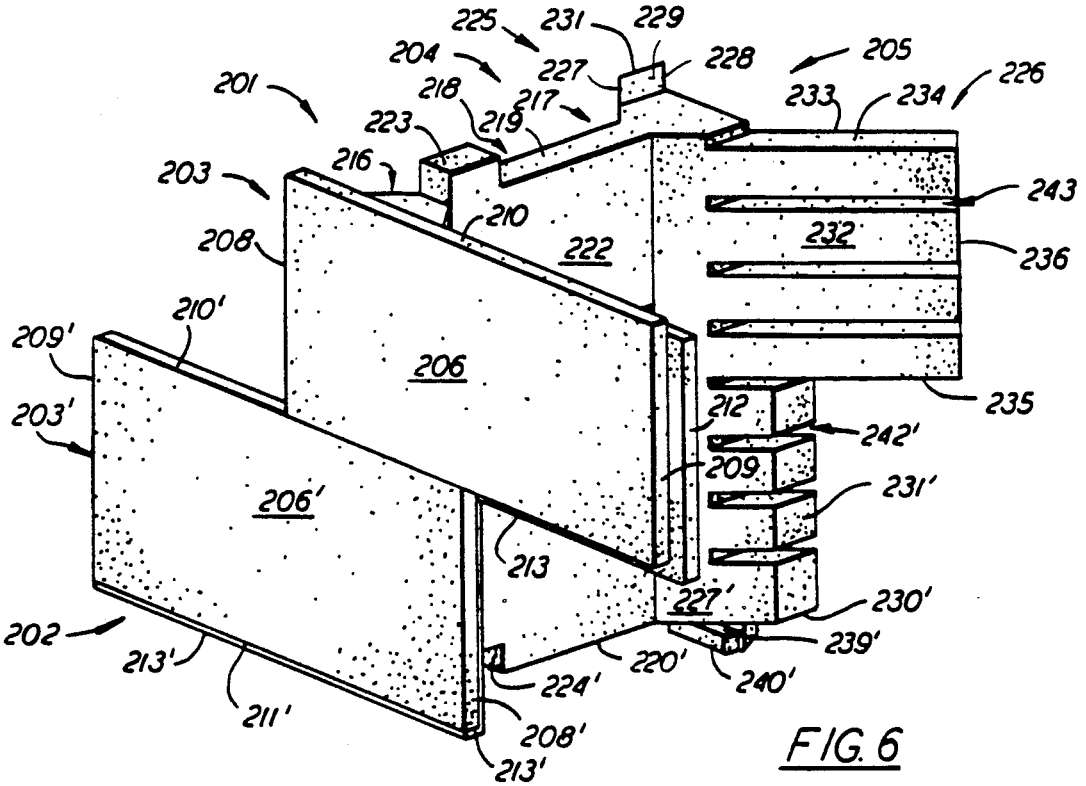
FIG. 6 is a perspective view similar to FIG. 1 of two precast concrete modules according to an alternative embodiment of the invention.

FIG. 6 shows two wall units 201 and 202 which represent variants of the units shown in FIGS. 1 to 5. These variants are particularly adapted for use in retaining walls where there is a large extent of backfill behind the anchor members of the wall units. As is apparent by comparing FIG. 6 with FIG. 1, units 201 and 202 are almost identical to units 101 and 102. Corresponding elements are identified by "200"-series reference numerals that are otherwise the same as the "100"-series reference numerals of the previously described units, and no further description of these elements is necessary.

The only difference is that the first anchor wings of the "200"-series units are provided with vertically-spaced horizontal slots 242 (or 242') that extend to the outer edges 231 (or 231'), and the second anchor wings have similar slots 243 (or 243'). These slots receive reinforcing mats of metal grid or perforated polymer that may be laid in successive horizontal layers during the backfilling operation for each row of units as a wall is being assembled. The slots are wide enough so that the mats can be slipped in easily, and no connection is otherwise made between the mats and the units.

Figure 7:
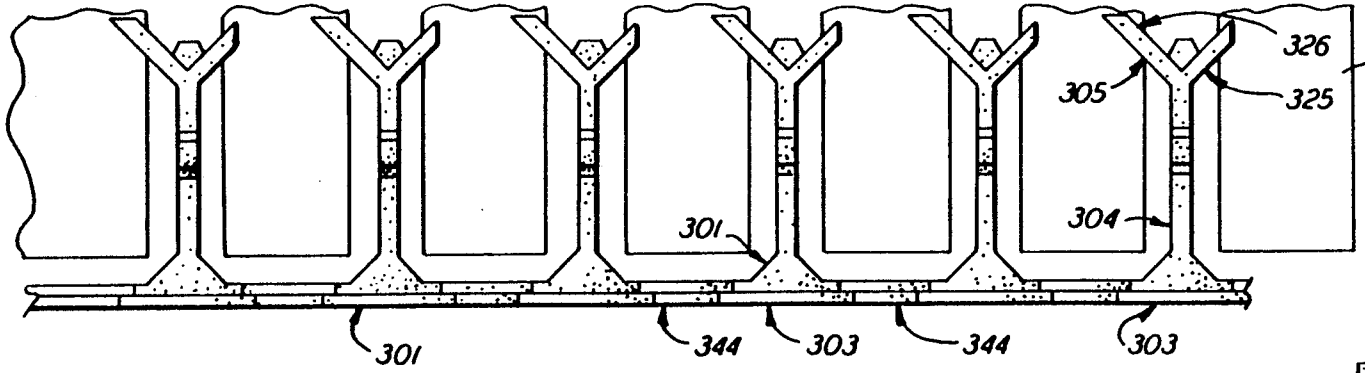
FIG. 7 is a top plan view of an assembled horizontal row of the wall units of FIG. 6.
Figure 8:
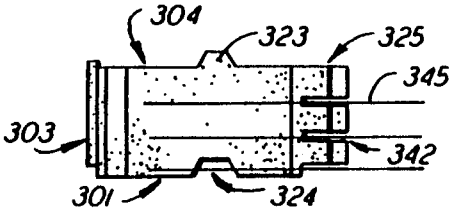
FIG. 8 is a side elevation view of the wall unit assembly of FIG. 7.
Figure 9:
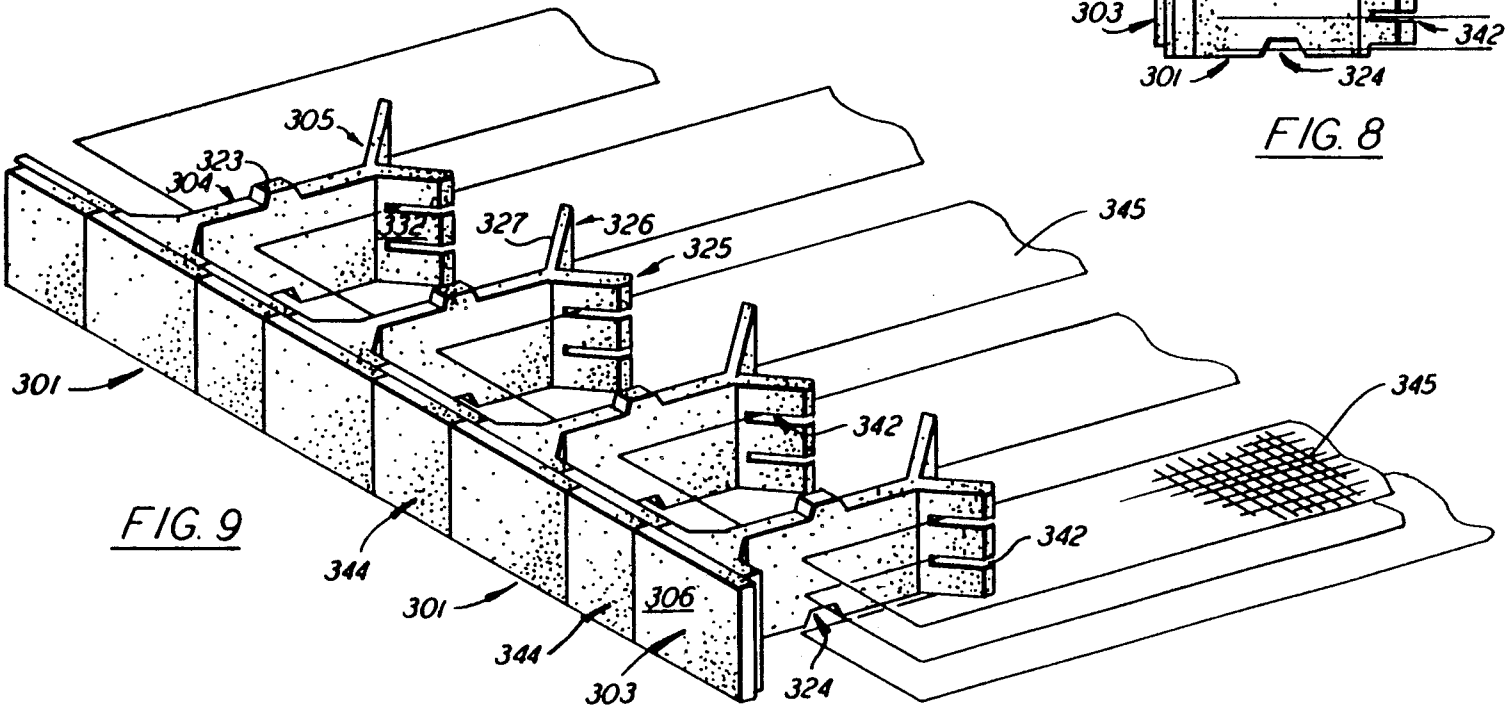
FIG. 9 is a front perspective view of the wall unit assembly of FIG. 7.

FIGS. 7–9 illustrate a row of wall units 301 according to another embodiment of the invention which have been combined with reinforcing mats. In these figures the backfill material is not shown so that the details of the assembly can be understood. Units 301 are similar to the units of FIGS. 1–4, with the following exceptions. The face members 303 are approximately half the width of the face members of the previous units, and the support members 304 are connected to the centers of the face members. To obtain the same spacing between units in the row, drop-in panels 344 of appropriate width are placed between the units 301. To hold the drop-in panels in place against the pressure of backfill material, the arrangement of rear lips and recesses on the face members of the previous units are altered so that there are recesses along both side edges of the units and mating rear lips along both side edges of the drop-in panels.

Between each pair of units 301 elongated mats 345 extend from a location adjacent to the face members, through horizontal slots 342 in the first anchor wings 325 and through similar slots (not shown) in the second anchor wings 326 to a substantial distance behind the anchor members, as dictated by the available fill area or the length of engagement needed to develop the desired resistance against lateral forces acting on the wall.

As seen most easily in the plan view of FIG. 7, the provision of anchor wings 325 and 326 of different lengths permits easy access into the spaces between the face members and the anchor members of adjacent units. At the same time, however, the wings 325 and 326 of adjacent units capture all of the backfill material between the units because the angle of the wings produces a wedging effect, so that the shear forces exerted by the wings on the backfill material are directed perpendicularly to the front faces 327 and 332 of the wings instead of parallel to the support members 304. For this reason, the entire area of the portion of each mat 345 is available to reinforce and stabilize the earth mass between the units. As a result, the backfilled material between the units becomes integrated with the units without any need to attach the mats directly to the units. This feature also saves time and expense over conventional systems which must connect the reinforcing mats directly to the face members of the retaining wall using expensive and corrodible hardware.

Other differences between the units 301 of FIGS. 7–9 and the units of the previous embodiments include the placement of tabs 323 and notches 324 in the middle of the support members instead of at the front and the provision of only two horizontal slots per anchor wing instead of three. The placement of the tabs and notches is a design choice, and the number of slots depends on the desired vertical spacing between reinforcing mat layers and is a function of the type of backfill material, the length of the support members, and the intended height of a given wall assembly. The effect of these variables can be predicted by a person skilled in soil mechanics and verified, as desirable, by tests.

To add further rows to the wall shown in FIGS. 7–9, identical units 301 can be stacked directly on top of respective units in the first row, to maintain vertical alignment of the support members, or variant units (not shown) having the first and second anchor wings reversed could be used. Either of these arrangements results in alignment of all vertical joints, which is usually less desirable than having staggered vertical joints, but this embodiment would be one of choice for a wall having pronounced convex or concave curvature, for example. Because of the large space between the anchor wings of adjacent units, they can be arranged in a convex curve of relatively short radius, which is another advantage of the present invention.

Figure 10:
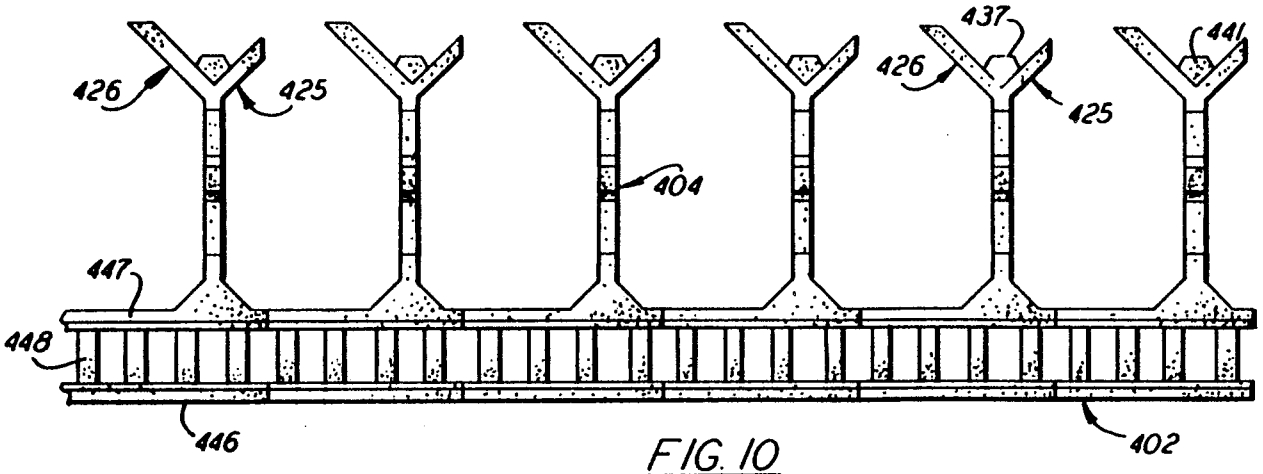
FIG. 10 is a top plan view of an assembly similar to FIG. 7 of another alternative embodiment of the precast concrete wall unit of the invention.
Figure 12:
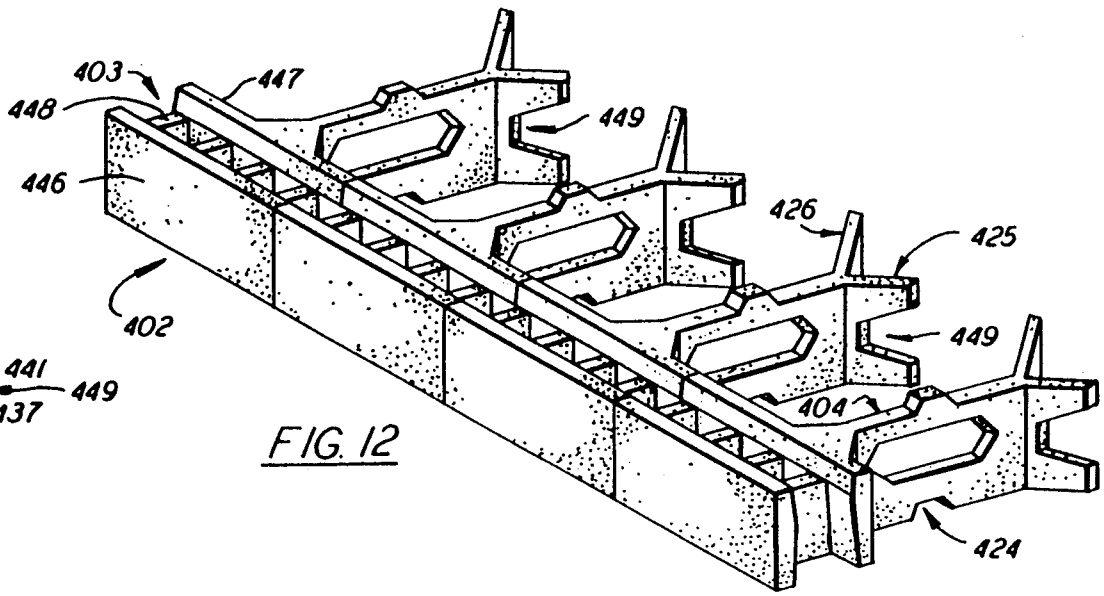
FIG. 12 is a front perspective view of the assembly of FIG. 10.
Figure 11:
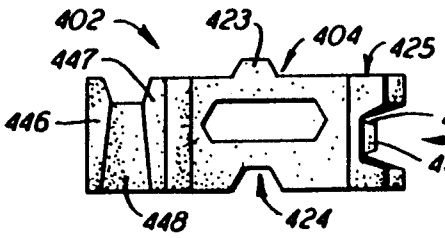
FIG. 11 is a side elevation view of the assembly of FIG. 10.

With reference next to FIGS. 10–12, left-handed wall units 402 represent still another embodiment of the basic left-handed module 102 of the invention. The principal feature of this embodiment is the provision of a face member 403 having double walls 446 and 447 spaced apart by connecting webs 448. This feature is particularly adapted for load bearing retaining walls such as bridge abutments. When units 402 and corresponding right-handed mirror image units (not shown) similar to basic units 1O1 are assembled in alternate staggered rows, the walls 446 and 447 provide a cellular form which can be filled with concrete to create a thick monolithic bearing wall. As shown in FIG. 11, the tops of the connecting webs 448 are recessed below the tops of the walls 446 and 447. This provides space for horizontal reinforcing bars which, when connected with vertical reinforcing bars placed in at least some of the spaces between adjacent connecting webs create a reinforced concrete grid, after the spaces are filled with concrete, that ties the entire wall together into a structure of exceptional strength.

Because the assembled wall is tied together by the subsequently poured concrete between the double walls of the face members, there is no need for lips and recesses to interlock the face members of adjacent units 402. Tabs 423 and notches 424 help to locate the units during assembly, but have no structural function in the completed wall assembly after concrete has been poured between the double walls.

To counteract to some degree the increased unit weight resulting from the double wall face members, the support members 404 of units 402 are formed as open frames, and the anchor wings 425 and 426 have large cut out central portions 449. The open frame support member and large cut out portions of the wings can, of course, be incorporated into the other embodiments to reduce weight and the amount of material used. The large openings in the wings accommodate two or more vertically spaced layers of reinforcing mats, if it is desired to stabilize the backfill material in the manner shown in FIGS. 7–9.

In this embodiment, the prismatic stub 437 does not extend below the bottom of the support member 404 and does not provide an interlock with a unit immediately below. The top 441 of the stub acts as a shelf to support backfill material, however, in the same manner as previously described. If no rear interlock is required for an application using one of the other embodiments, this type of stub arrangement could be substituted, or the stub could be eliminated.

Figure 13:
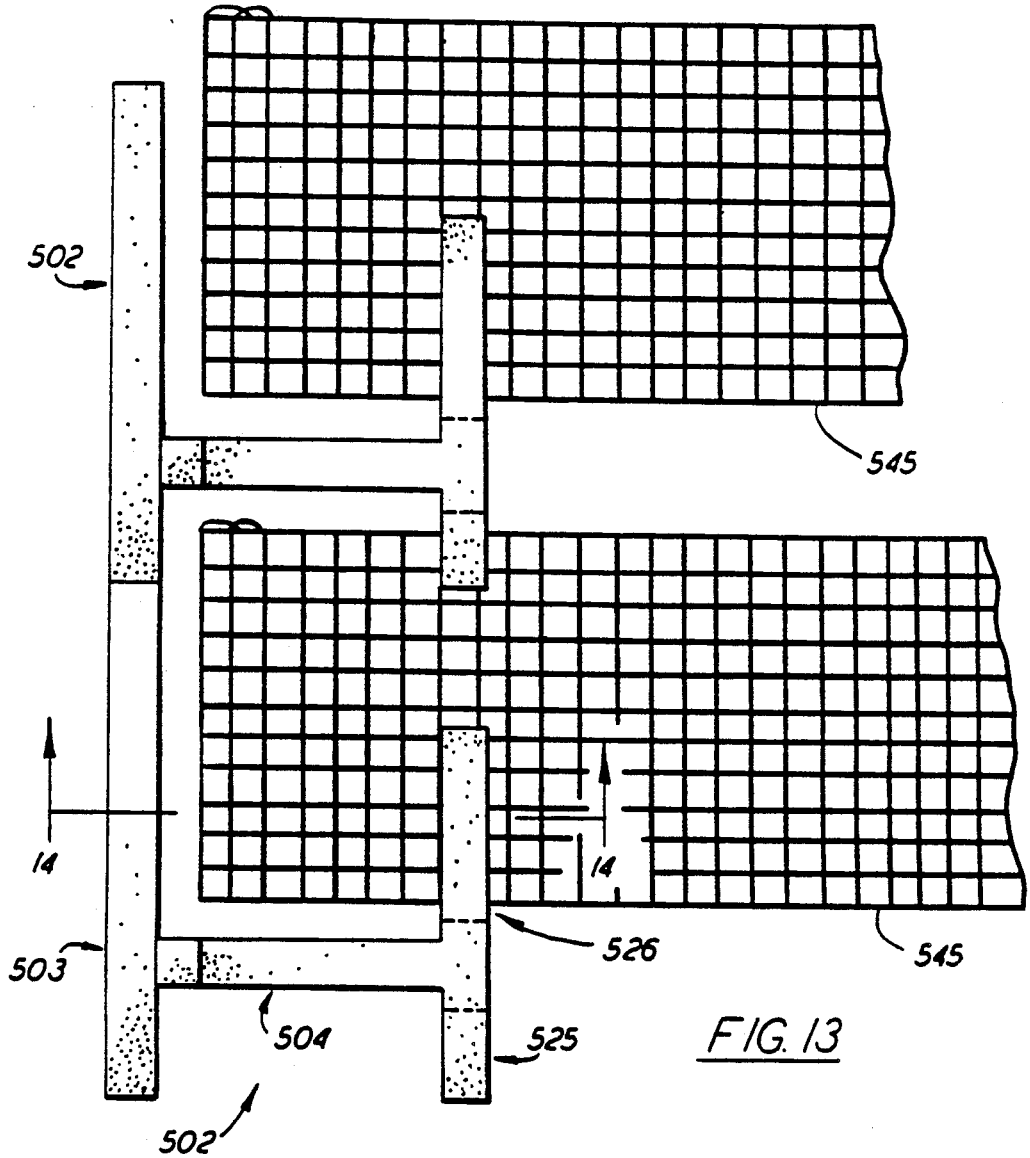
FIG. 13 is a top plan view of still another embodiment of wall units assembled side-by-side.
Figure 14:
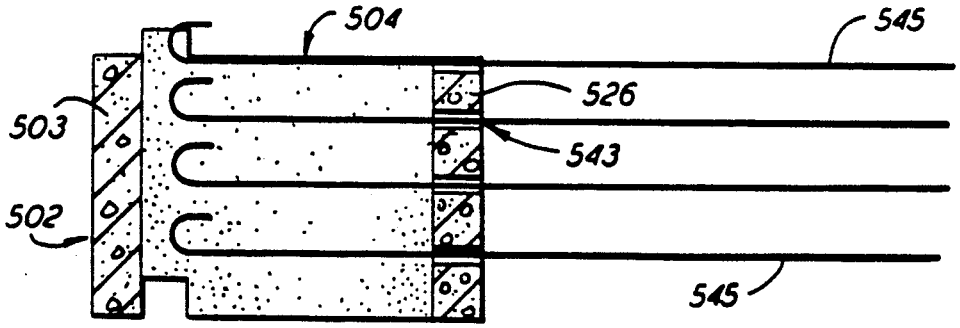
FIG. 14 is a side elevation view of the assembly of FIG. 13.

FIGS. 13 and 14 illustrate yet another embodiment of a left-handed unit 502 having anchor wings 525 and 526 of unequal length that extend at right angles to the support member 504. The face members 503 of this embodiment are plane rectangular slabs with no rear interlocking lips and recesses as provided in the units of the first embodiment. The wings have horizontal open ended slots (only slots 543 in second wing 526 are shown) similar to those shown in the embodiment of FIG. 5 for loosely receiving reinforcing mats 545. In this arrangement, as best seen in FIG. 14, the forward ends of the mats are curled up and returned a short distance to underlie the mat of the next layer to provide still greater resistance to pull-out from the backfill material (not shown).

The procedure for assembling a retaining wall incorporating the reinforcement mats of the embodiments shown in FIGS. 7–14 includes setting a plurality of units in a first row on a footing (not shown) that has been either precast or poured in the field in known manner. If the units are provided with rear lips and recesses on the face members, these lips and recesses should be mated together as shown in the drawings. A layer of backfill material is then distributed between and behind the units and compacted with a power tamper to a predetermined thickness. If units having anchor wings with a plurality of slots, as shown in FIGS. 6, 7–9, and 13–14, are used, the first backfill layer should reach to the level of the lowest slot. A mat of metal grid or high tensile strength polymer, such as is sold under the trademark "Tensar," is laid between each pair of adjacent units, with the mat fitting loosely in the lowest slots of the wings, the width of the mat being slightly less than the spacing between support members of adjacent units, and the length being selected so that the mat extends from near the rear surfaces of the face members to a desired distance behind the anchor members. Another layer of backfill material is then distributed and tamped to the level of the second slots in the anchor wings, another reinforcing mat is placed on the second layer, fitting loosely in the second slots, and so on. Additional rows of units and layers of reinforcing mats can be assembled to reach an overall retaining wall height that greatly exceeds the height possible if the units were only backfilled without the layers of reinforcing mats.

From the foregoing description, it is clear that a precast concrete wall unit having a face member, a support member, and an integral anchor member in the form of first and second wings of unequal length presents a number of advantages in providing a retaining wall assembly that is quick and easy to erect yet has high stability for its size. The retaining wall units can be used with layers of reinforcing mats to obtain maximum resistance to lateral and overturning forces without needing to fasten the mats directly to the units.

I claim:

1. A precast concrete retaining wall unit for use in constructing a retaining wall composed of superposed rows of such units, the unit comprising:

a face member having a front surface for forming part of an exposed face of a retaining wall, a rear surface, an upper edge, a lower edge, and first and second side edges;

a single support member having a top, a bottom, a first side, a second side, a front end portion, a rear end portion spaced from the front end portion, and an intermediate portion connecting the front and rear end portions, the front end portion of the support member being connected to the rear surface of the face member; and an anchor member formed integrally with the rear end portion of the support member, the anchor member including a first wing extending at an angle of at least 90° from the first side of the support member and a second wing extending at an angle of at least 90° from the second side of the support member opposite to the first side, wherein the length of the first wing is substantially less than the length of the second wing,;

wherein the front end portion of the support member is formed integrally with the face member so as to extend rigidly and substantially perpendicularly to the rear surface of the face member at a location spaced from the first side edge of the face member by approximately one-fourth the distance between the first and second side edges of the face member.

2. A precast concrete retaining wall unit according to claim 1 wherein each of the first and second wings of the anchor member extends at an angle of approximately 135° with the respective side of the support member.

3. A precast concrete retaining wall member according to claim 1 wherein each anchor wing has at least one horizontal opening extending inward from the outer side edge of the wing, the opening extending to adjacent the respective side of the support member and being large enough in vertical extent to loosely receive at least one layer of a reinforcing mat for stabilizing backfill placed around the unit.

4. A precast retaining wall unit according to claim 1 wherein the face member comprises a cellular structure a front wall, a rear wall spaced from the front wall, and a plurality of vertical spaced apart webs connecting the front wall to the rear wall.

5. A precast retaining wall unit according to claim 4 wherein the height of the connecting webs is less than the height of the front and rear walls of the face member.

6. A precast retaining wall unit according to claim 1 wherein each unit includes an interlock means disposed behind the anchor members for interlocking the rear end portion of the support member against relative vertical and forward movement with respect to a support member of a unit positioned immediately below.

7. A precast concrete retaining wall unit according to claim 6 wherein the interlocking means comprises a prismatic stub integrally formed on a rear surface of the support member of each unit, the stub extending below the bottom of the support member and having a front face that is coplanar with the rear surface of the support member, and one of the front face of the stub and the rear surface of the support member having a protrusion and the other having a mating depression located to interengage when two units are positioned with one support member immediately below the other.

8. A retaining wall assembly composed of a plurality of superposed rows of precast concrete units, each unit comprising:

a face member having a front surface, a rear surface, an upper edge, a lower edge, and first and second side edges;

a single support member having a top, a bottom, a first side, a second side, a front end portion, a rear end portion spaced from the front end portion, and an intermediate portion connecting the front and rear end portions, the front end portion of the support member being connected to the rear surface of the face member; and an anchor member formed integrally with the rear end portion of the support member, the anchor member including a first wing extending at an angle of at least 90° from the first side of the support member and a second wing extending at an angle of at least 90° from the second side of the support member opposite to the first side, wherein the length of the first wing is substantially less than the length of the second wing, wherein each wing has openings that extend from the outer edge of the wing to adjacent the support member, and wherein the assembly further comprises backfill material filling spaces between the units and a plurality of open mesh reinforcing mats disposed within the backfill material in vertically spaced horizontal layers and extending from a front end located adjacent the rear faces of the units loosely through said openings to a rear end located behind the anchor members, there being no direct connection between the reinforcing mats and the units.

9. A retaining wall assembly according to claim 8 where the front end of each reinforcing mat is curled up and returned a short distance to underlie the mat of the next layer.

* * * * *